US008519913B2

(12) United States Patent
Choi

(10) Patent No.: US 8,519,913 B2
(45) Date of Patent: Aug. 27, 2013

(54) PIXEL AND ORGANIC LIGHT EMITTING DISPLAY DEVICE USING THE SAME

(75) Inventor: Sang-Moo Choi, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 294 days.

(21) Appl. No.: 12/857,185

(22) Filed: Aug. 16, 2010

(65) Prior Publication Data

US 2011/0109531 A1 May 12, 2011

(30) Foreign Application Priority Data

Nov. 6, 2009 (KR) ..... 10-2009-0106919

(51) Int. Cl.
*G09G 3/30* (2006.01)
*G06F 3/038* (2006.01)

(52) U.S. Cl.
USPC ..... 345/76; 345/212

(58) Field of Classification Search
USPC ..... 345/207, 211, 76
See application file for complete search history.

(56) References Cited

U.S. PATENT DOCUMENTS

2008/0290805 A1* 11/2008 Yamada et al. ..... 315/169.1
2010/0033510 A1* 2/2010 Handa et al. ..... 345/690

FOREIGN PATENT DOCUMENTS

| | | |
|---|---|---|
| JP | 2007-79599 | 3/2007 |
| KR | 10-0624137 | 9/2006 |
| KR | 1020060104841 A | 10/2006 |
| KR | 1020070066491 A | 6/2007 |
| KR | 10-2008-0043712 A | 5/2008 |
| KR | 10-2009-0047359 | 5/2009 |

OTHER PUBLICATIONS

KIPO Office Action for Korean priority patent application No. 10-2009-0106919, dated Jul. 29, 2011, 1 page.
Office action dated Apr. 21, 2011 for the corresponding Korean priority application No. 10-2009-0106919; 3 pages.

* cited by examiner

*Primary Examiner* — Michael Faragalla
(74) *Attorney, Agent, or Firm* — Christie, Parker & Hale, LLP

(57) ABSTRACT

A pixel includes: an organic light emitting diode including an anode electrode and a cathode electrode, where the cathode electrode is connected with a second power supply; a first transistor including a gate electrode, where the first transistor is connected between a first power supply and the organic light emitting diode, where the first transistor is configured to control an amount of current flowing from the first power supply through the organic light emitting diode to the second power supply; a second transistor connected between the gate electrode of the first transistor and the anode electrode of the organic light emitting diode; a third transistor connected between the first transistor and the first power supply; and a storage capacitor connected between the gate electrode of the first transistor and a data line.

30 Claims, 14 Drawing Sheets

PIXEL AND ORGANIC LIGHT EMITTING DISPLAY DEVICE USING THE SAME

CROSS-REFERENCE TO RELATED APPLICATIONS

This application claims priority to and the benefit of Korean Patent Application No. 10-2009-0106919, filed in the Korean Intellectual Property Office on Nov. 6, 2009, the entire content of which is incorporated herein by reference.

BACKGROUND

1. Field

The embodiment of the present invention relates to a pixel and an organic light emitting display device using the same.

2. Description of Related Art

In recent years, various flat panel display devices with reduced weight and volume in comparison to a cathode ray tube have been developed. Examples of the flat panel display devices include a liquid crystal display device, a field emission display device, a plasma display panel, and an organic light emitting display device.

An organic light emitting display device displays images by using organic light emitting diodes that emit light by recombination of electrons and holes. Such an organic light emitting display device has a rapid response speed and is driven with low power consumption.

An organic light emitting display device includes a plurality of pixels that are arranged in a matrix at crossing regions of a plurality of data lines, scan lines, and power lines. Each pixel typically includes an organic light emitting diode, two or more transistors including a driving transistor, and one or more capacitors.

A disadvantage of such an organic light emitting display device is that the amount of current that flows to the organic light emitting diode varies depending on a threshold voltage of the driving transistor provided in each of the pixels. Characteristics of the driving transistor provided in each of the pixels vary due to inconsistencies of a manufacturing process of the driving transistor. It is difficult to manufacture the transistors used in each of the pixels in the organic light emitting display device to have the same characteristics given the current processing technology. This results in variability in the threshold voltage of the driving transistors in each of the pixels, which causes a non-uniform display luminance.

A compensation circuit including a plurality of transistors and capacitors in each of the pixels is added to the organic light emitting display device. The compensation circuit included in each of the pixels charges a voltage corresponding to a threshold voltage of the driving transistor to thereby compensate for the variability in threshold voltages among the driving transistors in each of the pixels.

However, in the related art, reliability may be deteriorated as the structure of the compensation circuit becomes more complex to manufacture. For example, when the compensation circuit is included, each of the pixels includes five or more transistors and two or more capacitors. Each additional transistor and capacity increases the manufacturing cost and deteriorates the reliability of the compensation circuit.

SUMMARY

Aspects of embodiments of the present invention are director toward a pixel and an organic light emitting display device using the same that can compensate a threshold voltage of a driving transistor by using a small number of transistors and/or capacitors.

According to an embodiment of the present invention, a pixel includes: an organic light emitting diode including an anode electrode and a cathode electrode, where the cathode electrode is connected with a second power supply; a first transistor including a gate electrode, where the first transistor is connected between a first power supply and the organic light emitting diode, where the first transistor is configured to control an amount of current flowing from the first power supply through the organic light emitting diode to the second power supply; a second transistor connected between the gate electrode of the first transistor and the anode electrode of the organic light emitting diode; a third transistor connected between the first transistor and the first power supply; and a storage capacitor connected between the gate electrode of the first transistor and a data line.

According to another embodiment of the present invention, an organic light emitting display device in which a frame is driven by being divided into a reset period, a compensation period, and an emission period, the organic light emitting display device including: a plurality of pixels at crossing regions of a plurality of scan lines, a plurality of emission control lines, and a plurality of data lines, the plurality of pixels being configured to be in a non-emission state during the reset period and the compensation period, and in an emission state during the emission period; a data driver configured to sequentially supply a first reset voltage and a second reset voltage to each of the plurality of data lines during the reset period; a scan driver configured to simultaneously supply a scan signal to each of the plurality of scan lines during the reset period, where the scan driver is also configured to supply an emission control signal to each of the plurality of emission control lines; and a first power supply configured to supply a first power to each of the plurality of pixels, where the first power has different voltage levels during the reset period, the compensation period, and the emission period.

According to yet another embodiment of the present invention, an organic light emitting display device in which a frame is driven by being divided into a reset period, a compensation period, and an emission period, the organic light emitting display device including: a plurality of pixels at crossing regions of a plurality of scan lines, a plurality of emission control lines, and a plurality of data lines, the plurality of pixels configured to be in a non-emission state during the reset period and the compensation period, and in an emission state during the emission period; a scan driver configured to supply a scan signal to each of the plurality of scan lines during the reset period and configured to sequentially supply the scan signal to each of the plurality of scan lines during the compensation period, where the scan driver is also configured to supply an emission control signal to each of the plurality of emission control lines; and a data driver configured to supply a data signal to each of the data lines, where the data signal is synchronized with the scan signal during the compensation period.

In an embodiment of the present invention, it is possible to compensate for a threshold voltage of a driving transistor by using a pixel constituted by three, four or more transistors and one capacitor. Further, in the embodiment of the present invention, it is possible to arbitrarily set a compensation time of the threshold voltage of the driving transistor by controlling a driving waveform supplied to the pixel.

BRIEF DESCRIPTION OF THE DRAWINGS

The accompanying drawings, together with the specification illustrate exemplary embodiments of the present invention, and, together with the description, serve to explain the principles of the present invention.

DETAILED DESCRIPTION

Figure 1:
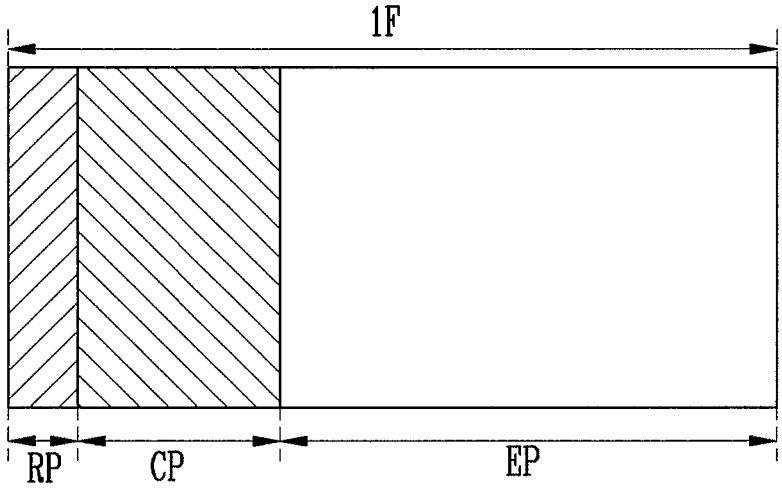
FIG. 1 is a diagram showing one frame period according to an embodiment of the present invention.

In the following detailed description, only certain exemplary embodiments of the present invention are shown and described, by way of illustration. As those skilled in the art would recognize, the invention may be embodied in many different forms and should not be construed as being limited to the embodiments set forth herein. When a first element is described as being "coupled to" a second element, the first element may be not only directly coupled to the second element but may also be indirectly coupled to the second element with one or more intervening elements interposed therebetween. Further, some of the elements that are not essential to the complete understanding of the invention are omitted for clarity. Like reference numerals designate like elements throughout the specification.

While the present invention has been described in connection with certain exemplary embodiments, it is to be understood that the invention is not limited to the disclosed embodiments, but, rather, is intended to cover various modifications and equivalent arrangements included within the spirit and scope of the appended claims, and equivalents thereof.

Hereinafter, preferred embodiments of the present invention will be described in more detail with reference to FIGS. 1 to 7 so that those skilled in the art can easily implement the present invention.

FIG. 1 is a diagram showing one frame period according to an embodiment of the present invention.

Referring to FIG. 1, one frame 1F according to the embodiment of the present invention includes a reset period RP, a compensation period CP, and an emission period EP.

During the reset period RP, an anode electrode of an organic light emitting diode OLED and a gate electrode of a driving transistor included in each of a plurality of pixels are initialized. For example, during the reset period RP, the anode electrode of the organic light emitting diode OLED and the gate electrode of the driving transistor are supplied with an initial voltage. During the reset period, each of the plurality of pixels is set to a non-emission state.

A threshold voltage of the driving transistor included in each of the pixels is compensated for during the compensation period CP. That is to say, during the compensation period CP, each of the pixels is charged with a voltage corresponding to the threshold voltage of the driving transistor. During the compensation period CP, the pixels are set to a non-emission state.

During the emission period EP, each of the pixels emits light having a luminance determined by the current flowing through the organic light emitting diode of each pixel. Since the threshold voltage of the driving transistor is compensated for during the compensation period CP, the current flowing through the organic light emitting diode is independent of the threshold voltage of the driving transistor. Thus, an image having a uniform luminance is displayed during the emission period EP regardless of any variability in threshold voltage among the driving transistors included in each of the pixels that make up the organic light emitting display device.

Figure 2:
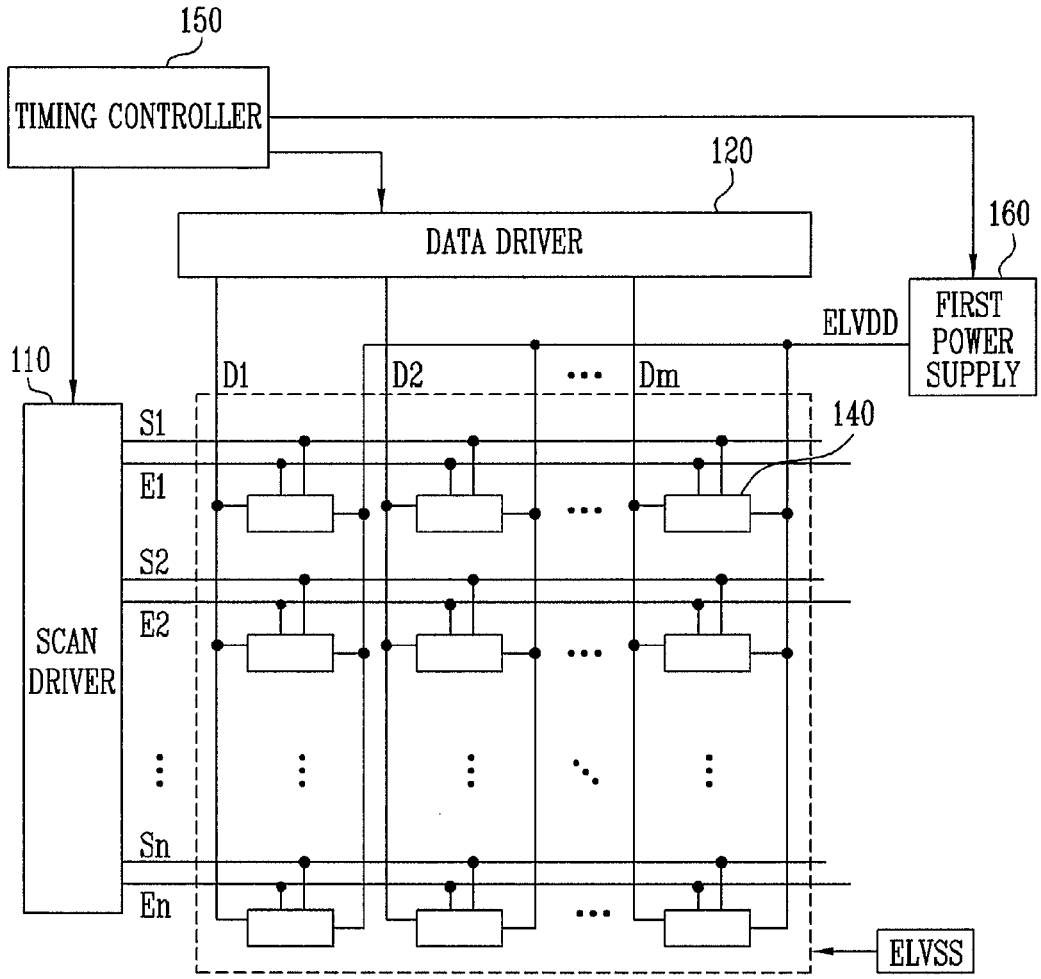
FIG. 2 is a diagram showing an organic light emitting display device according to an embodiment of the present invention.

FIG. 2 is a diagram showing an organic light emitting display device according to an embodiment of the present invention.

Referring to FIG. 2, the organic light emitting display device according to an embodiment of the present invention includes a plurality of pixels 140 that are positioned at crossing regions of a plurality of scan lines S1 to Sn, emission control lines E1 to En, and data lines D1 to Dm; a scan driver 110 for driving the scan lines S1 to Sn and the emission control lines E1 to En; a data driver 120 for driving the data lines D1 to Dm; a first power supply 160 for generating first power ELVDD; and a timing controller 150 for controlling the scan driver 110, the data driver 120, and the first power supply 160.

The scan driver 110 supplies a scan signal to the scan lines S1 to Sn during at least a part of the reset period RP. In addition, the scan driver 110 sequentially supplies the scan signal to the scan lines S1 to Sn during the compensation period CP. Further, the scan driver 110 supplies an emission control signal to the emission control lines E1 to En during at least part of the compensation period CP.

The data driver 120 sequentially supplies a first reset voltage and a second reset voltage to the data lines D1 to Dm during the reset period RP. Further, the data driver 120 supplies a data signal to the data lines D1 to Dm that is synchronized with the scan signal during the compensation period CP. In addition, the data driver 120 supplies a reference voltage to the data lines D1 to Dm during the emission period EP.

The first power supply 160 supplies a first power ELVDD having different voltage levels to the pixels 140 during the reset period RP, the compensation period CP, and the emission period EP. For example, the first power supply 160 supplies a first low power (or a first power at a low level) ELVDD_L, also called an initial voltage, having a low level during the reset period RP and supplies a first medium power (or a first power at a medium level) ELVDD_M having a medium level during the compensation period CP. In addition, the first power supply 160 supplies a first high power (or a first power at a high level) ELVDD_H having a high level during the emission period EP. Meanwhile, if the pixel 140 is directly supplied with an initial voltage from an outside source, the first power supply 160 can supply the first high power ELVDD_H during a frame period. A more detailed description thereof will be described below in reference to the structure of the pixel 140.

The timing controller 150 controls the scan driver 110, the data driver 120, and the first power supply 160 to correspond to synchronization signals supplied from an outside source.

Figure 3:
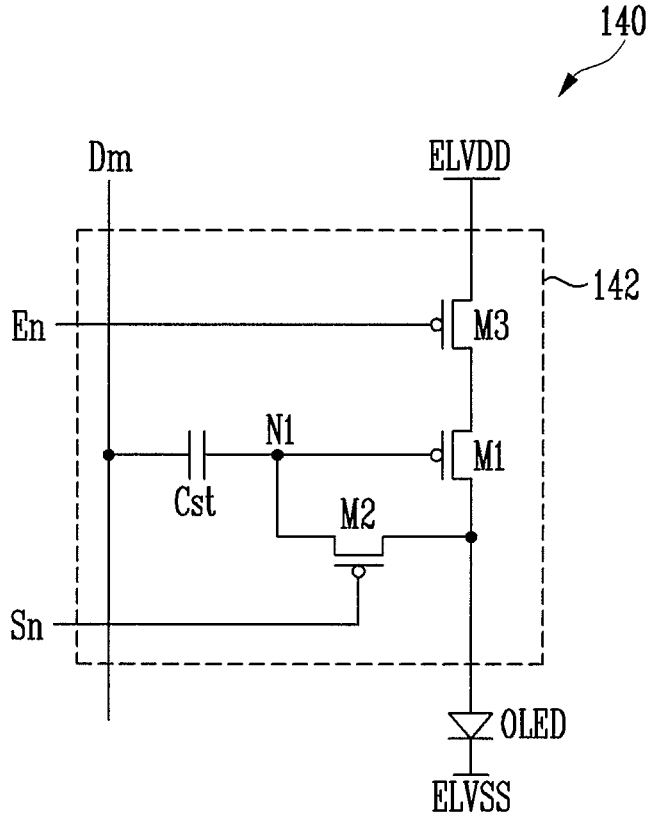
FIG. 3 is a circuit diagram showing a first embodiment of a pixel shown in FIG. 2.

FIG. 3 is a circuit diagram showing a pixel according to a first embodiment of the present invention. In FIG. 3, a pixel connected to the n-th scan line Sn and the m-th data line Dm is shown for convenience of description.

Referring to FIG. 3, the pixel 140 according to the first embodiment of the present invention includes an organic light emitting diode OLED and a pixel circuit 142 that is connected to a data line Dm, a scan line Sn, and an emission control line En to control the organic light emitting diode OLED.

The pixels 140 are set such that the voltage of an anode electrode of the organic light emitting diode OLED and a gate electrode of a driving transistor are at an initial voltage during the reset period RP. In addition, the pixels 140 are charged with a voltage corresponding to a threshold voltage of the driving transistor during the compensation period CP and emit light corresponding to the data signal during the emission period EP.

An anode electrode of the organic light emitting diode OLED is connected to the pixel circuit 142, and a cathode electrode of the organic light emitting diode OLED is connected to receive a second power ELVSS. The organic light emitting diode OLED emits light having a luminance that is determined by the amount of current supplied from the pixel circuit 142.

The pixel circuit 142 includes first to third transistors M1, M2 and M3 and a storage capacitor Cst.

A gate electrode of a first transistor M1, also called a driving transistor, is connected to a first node N1, and a first electrode of the first transistor M1 is connected to a second electrode of a third transistor M3. In addition, a second electrode of the first transistor M1 is connected to the anode electrode of the organic light emitting diode OLED. The first transistor M1 controls the amount of current supplied to the organic light emitting diode OLED. Voltage applied to the first node N1 determines whether the first transistor M1 is switched on or off.

A first electrode of a second transistor M2 is connected to the second electrode of the first transistor M1, and a second electrode of the second transistor M2 is connected to the first node N1. In addition, a gate electrode of the second transistor M2 is connected to the scan line Sn. The second transistor M2 is switched on when a scan signal is supplied to the scan line Sn. When the second transistor M2 is switched on, the first transistor M1 acts as a diode.

A first electrode of the third transistor M3 is connected to receive a first power ELVDD, and a second electrode of the third transistor M3 is connected to the first electrode of the first transistor M1. In addition, a gate electrode of the third transistor M3 is connected to the emission control line En. The third transistor M3 is switched off when the emission control signal is supplied to the emission control line En and switched on when the emission control signal is not supplied.

The storage capacitor Cst is connected between the first node N1 and the data line Dm. The storage capacitor Cst is charged with a voltage resulting from adding the threshold voltage of the first transistor M1 to a voltage corresponding to the data signal.

FIGS. 4A to 4D are waveform diagrams showing an embodiment of a first driving method of a pixel shown in FIG. 3. In FIGS. 4A to 4D, a driving waveform supplied to the n-th scan line Sn and the m-th data line Dm is shown for convenience of description.

Figure 4A:
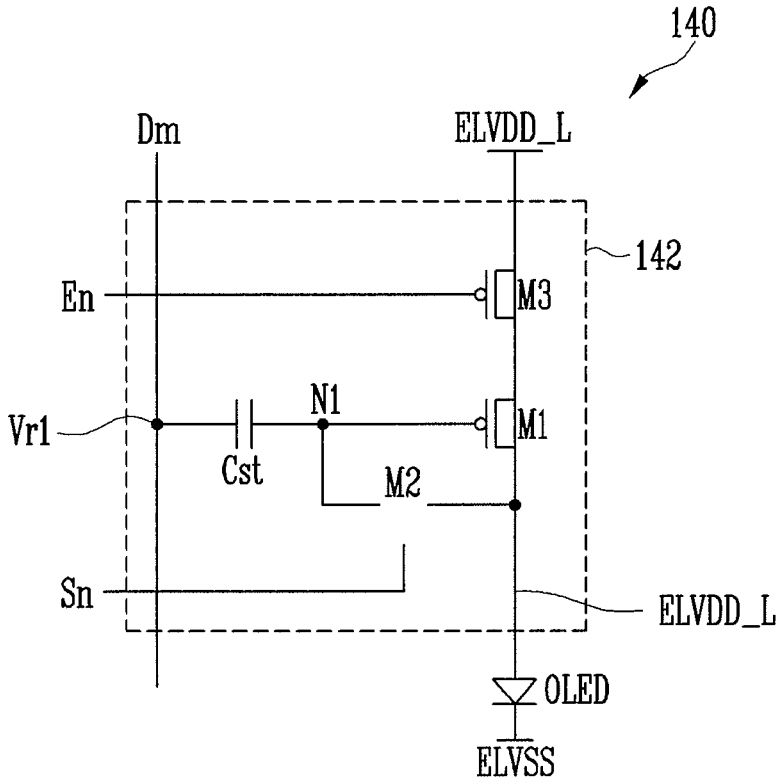
FIGS. 4A to 4D are waveform diagrams showing an embodiment of a first driving method of a pixel shown in FIG. 3.
Figure 4A:
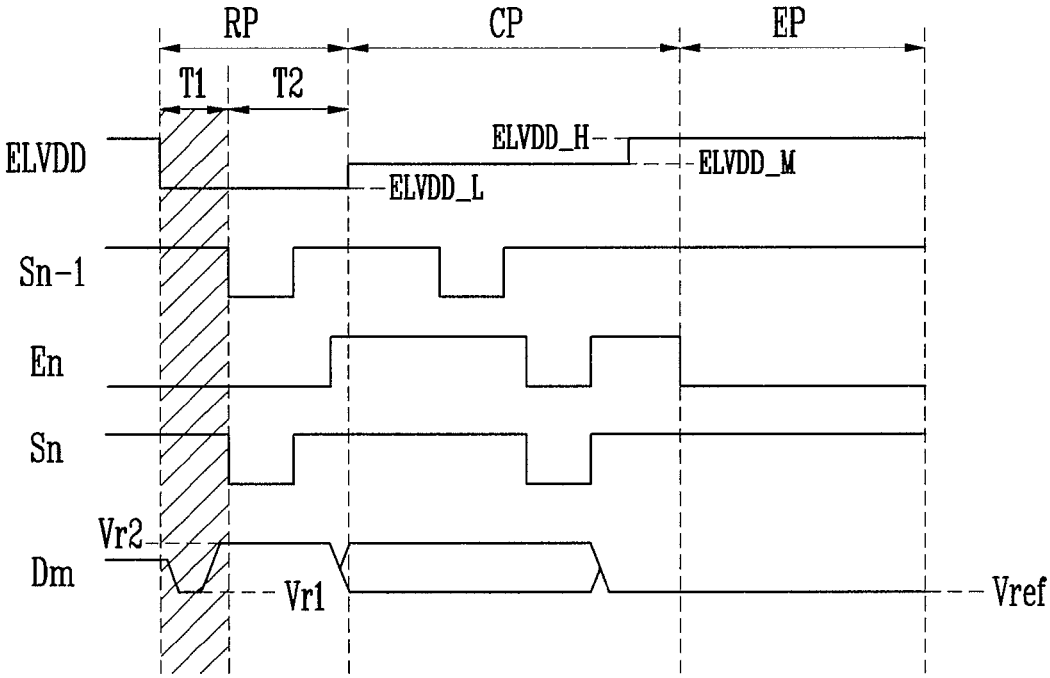

Herein an operation process is described. First, a first low power ELVDD_L is supplied to pixel circuit 142 during a first period T1 of a reset period RP as shown in FIG. 4A. When first reset voltage Vr1 is supplied to a data line Dm, the voltage at a first node N1 drops because it is coupled to a storage capacitor Cst. Herein, the first reset voltage Vr1 is set to a low voltage at which a first transistor M1 can be switched on. When the first transistor M1 is switched on, the voltage of an anode electrode of an organic light emitting diode OLED drops to the voltage of the first low power ELVDD_L. Herein, the first low power ELVDD_L is set to a voltage equal to or lower than a voltage of a second power ELVSS.

Figure 4B:
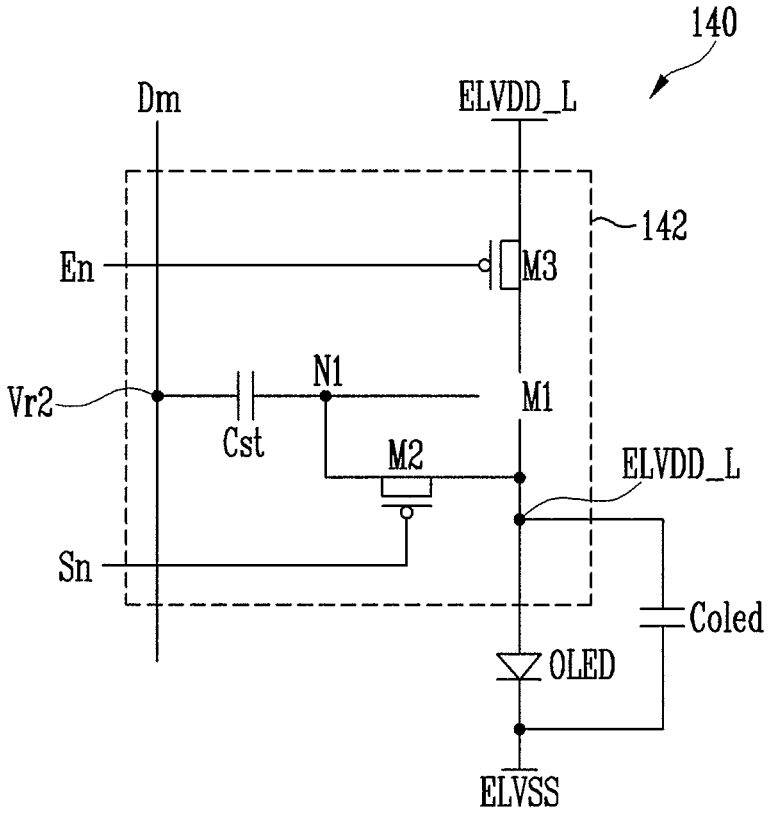
Figure 4B:
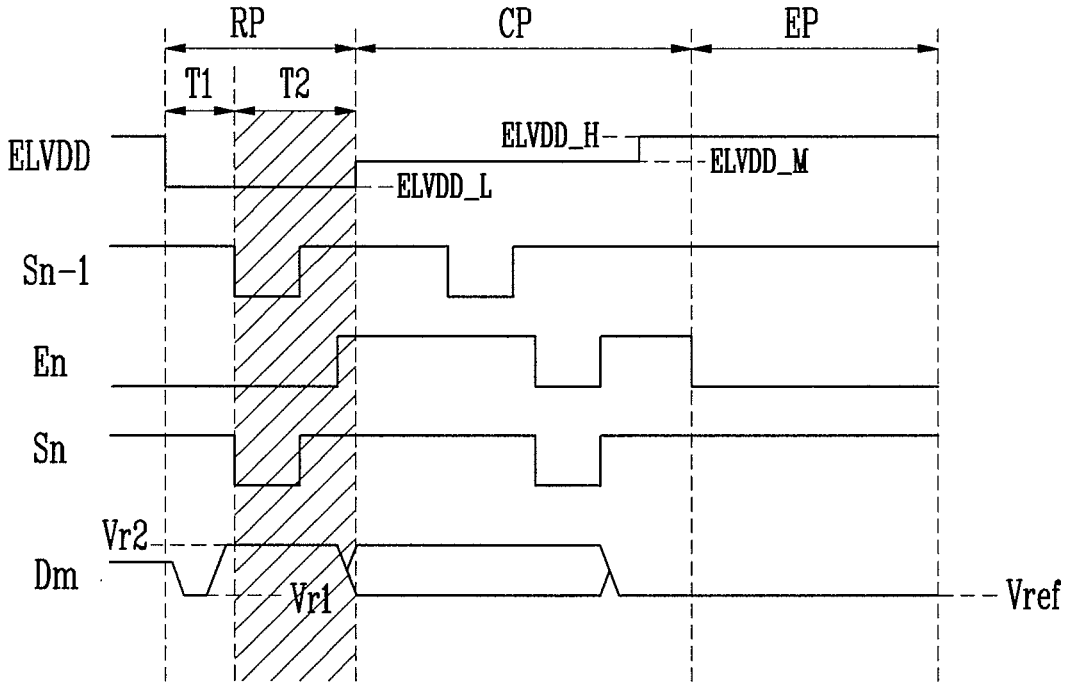

During a second period T2 of the reset period RP, as shown in FIG. 4B, a scan signal is supplied to scan lines S1 to Sn and a second reset voltage Vr2 is supplied to the data line Dm. When the second reset voltage Vr2 is supplied to the data line Dm, the voltage at the first node N1 increases because it is coupled to the storage capacitor Cst. The second reset voltage Vr2 is set to a voltage at which the first transistor M1 can be switched off.

When the scan signal is supplied to the scan line Sn, a second transistor M2 is switched on. When the second transistor M2 is switched on, the node N1 and the anode electrode of the organic light emitting diode OLED are electrically connected to each other. In this case, charge sharing exists between a voltage charged in the storage capacitor Cst and a parasite capacitor formed by the organic light emitting diode OLED, Coled. Herein, since the parasite capacitor Coled has a capacity larger than the storage capacitor Cst, the first node N1 is charged to the voltage of the first low power ELVDD_L during the second period T2.

Figure 4C:
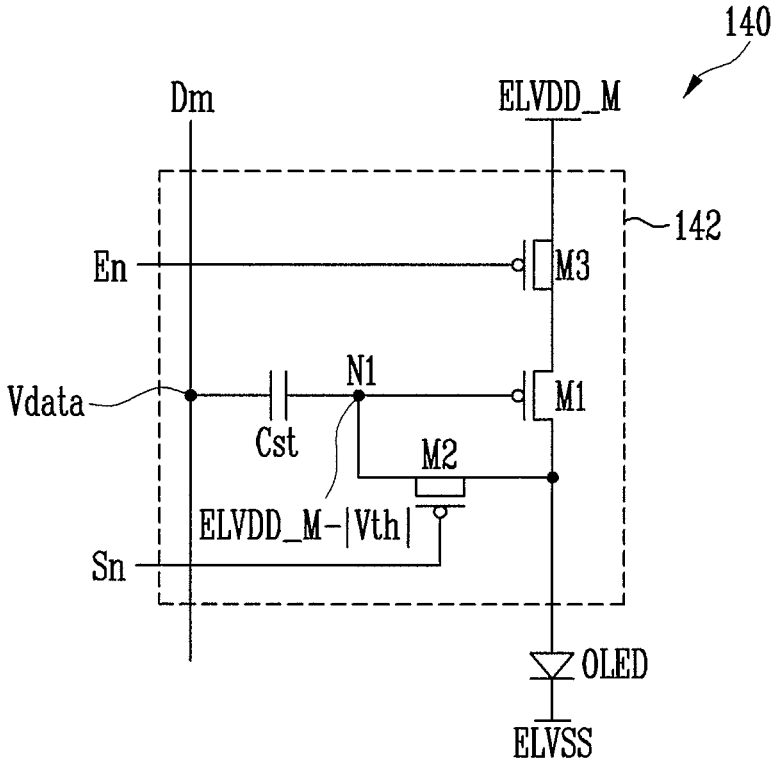
Figure 4C:
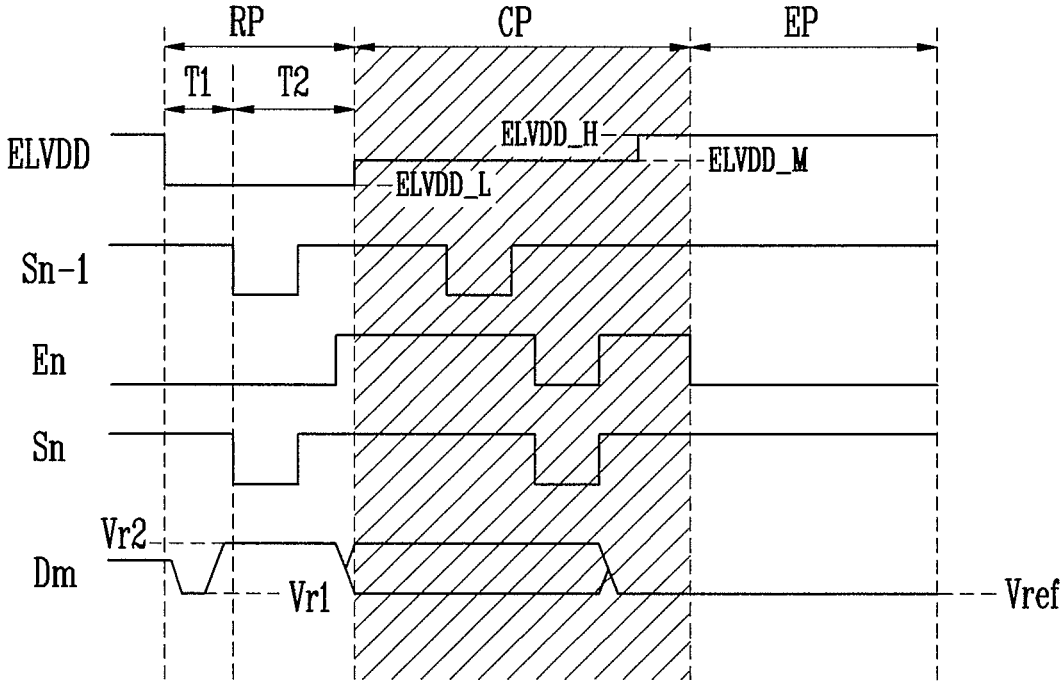

During the compensation period CP, as shown in FIG. 4C, the scan signal is supplied to the scan lines S1 to Sn in sequence and an emission control signal is supplied to the emission control lines E1 to En. Herein, the emission control signal supplied to an i-th emission control line Ei is supplied during the rest compensation period CP except for a period when the scan signal is supplied to the i-th scan line Si. Further, during the compensation period CP, the data signal supplied to data lines D1 to Dm is synchronized with the scan signal while the first medium power ELVDD_M is supplied.

When the scan signal is supplied to the scan line Sn, the second transistor M2 is switched on. In addition, during the period when the scan signal is supplied to the scan line Sn, the emission control signal is not supplied to the emission control line En. This means that the third transistor M3 is switched on. When the second transistor M2 and the third transistor M3 are switched on, the first medium power ELVDD_M is supplied to the first node N1 through the third transistor M3, the first transistor M1 and the second transistor M2. When the second transistor M2 is switched on, the first transistor M1 acts as a diode, so the voltage at the first node N1 is set to a voltage resulting from subtracting the threshold voltage of the first transistor M1, Vth, from the voltage of the first medium power ELVDD_M. During the compensation period CP, the storage capacitor Cst is charged with a voltage corresponding to the difference in voltage between the data signal voltage Vdata supplied to the data line Dm and the voltage applied to the first node N1. Thereafter, when the scan signal to the scan line Sn is no longer supplied, the first node N1 is set to a floating state.

Meanwhile, the first medium power ELVDD_M is set to a voltage at which the organic light emitting diode OLED can be turned off. This is to prevent unnecessary light from being emitted from the organic light emitting diode OLED. For example, when the voltage of the second power ELVSS is set to 2V and the threshold voltage of the organic light emitting diode OLED is set to 3V, the voltage of the first medium power ELVDD_M is set to 5V or less. When the voltage of the first medium power ELVDD_M is set to the voltage at which the organic light emitting diode OLED can be turned off, the voltage at the first node N1 is stably set to a voltage resulting from subtracting the threshold voltage of the first transistor M1, Vth, from the voltage of the first medium power ELVDD_M during the compensation period CP.

Figure 4D:
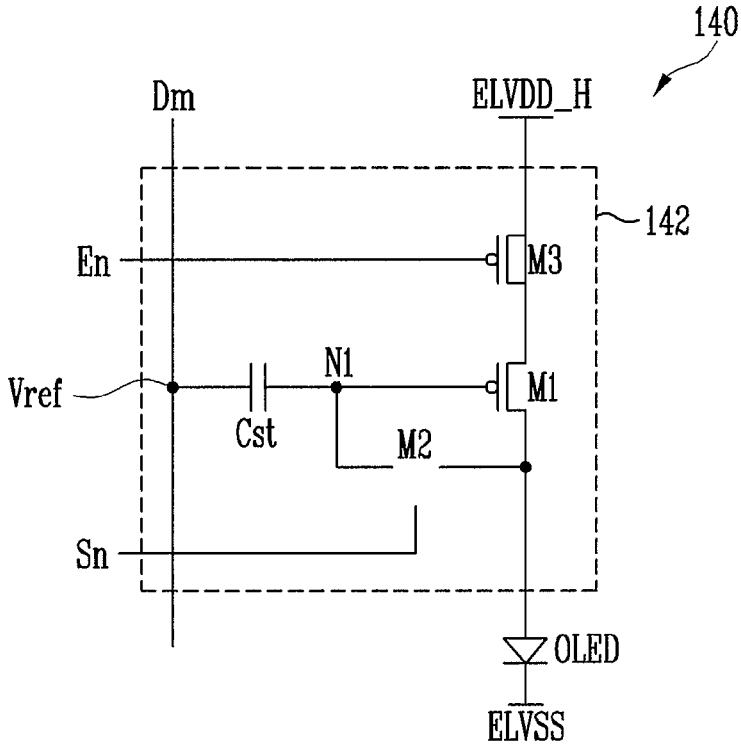
Figure 4D:
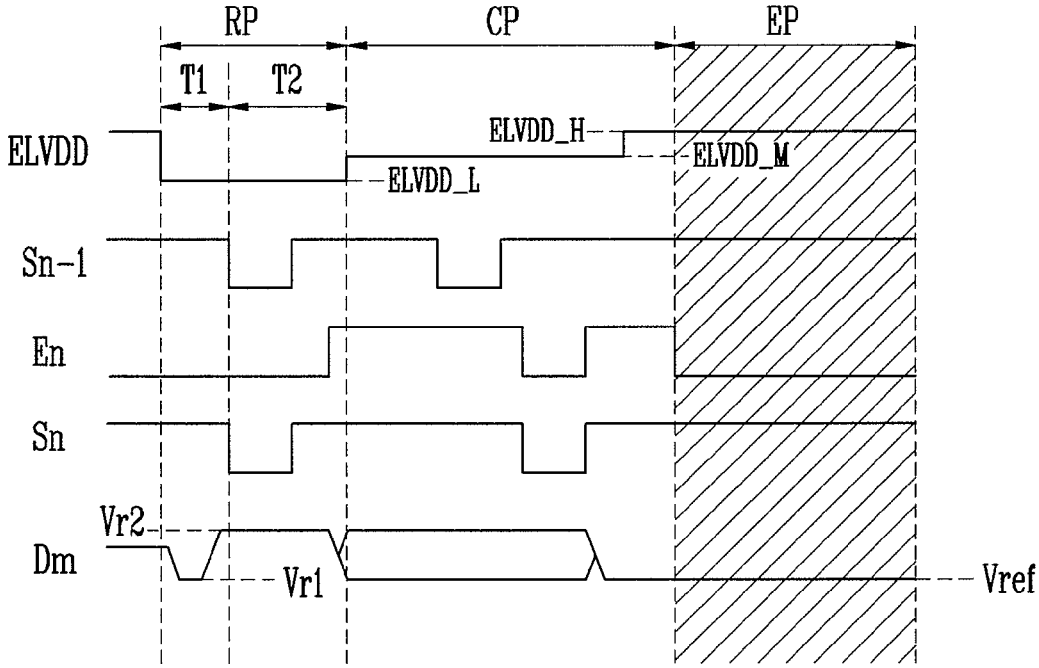

During the emission period EP, as shown in FIG. 4D, the first high power ELVDD_H is supplied to the pixel circuit 142, and the reference voltage Vref is supplied to the data line Dm. Herein, the first high power ELVDD_H is set to a voltage high enough so current can be supplied to the organic light emitting diode OLED. The reference voltage Vref is set to a voltage equal to or lower than the data signal voltage Vdata.

When the reference voltage Vref is supplied to the data line Dm, the voltage of the data line Dm decreases down to the reference voltage Vref from the data signal voltage Vdata. In this case, the voltage at the first node N1, $V_{N1}$, is set as shown in Equation 1.

$$V_{N1}=\text{ELVDD_}M-|V\text{th}|-(V\text{data}-V\text{ref}) \quad \text{Equation 1}$$

In Equation 1, |Vth| represents an absolute value of the threshold voltage of the first transistor M1.

When the voltage at the first node N1, $V_{N1}$, is set as shown in Equation 1, the current flowing to the organic light emitting diode OLED, $I_{OLED}$, is set as shown in Equation 2, where β is a constant.

$$I_{OLED}=\beta(V\text{sg}-|V\text{th}|)^2=\beta(\text{ELVDD_}H-V\text{ref}+V\text{data}-\text{ELVDD_}M+|V\text{th}|-|V\text{th}|)^2=\beta(\text{ELVDD_}H-\text{ELVDD_}M-V\text{ref}+V\text{data})^2 \quad \text{Equation 2}$$

Referring to Equation 2, in an embodiment of the present invention, the amount of current that flows to the organic light emitting diode OLED, $I_{OLED}$, can be controlled independently of the threshold voltage of the first transistor M1. Further, since the pixel 140 according to a first embodiment of the present invention includes just three transistors and one capacitor, reliability can be improved over compensation circuits containing more transistors and capacitors.

FIGS. 5A to 5E are waveform diagrams showing an embodiments of a second driving method of a pixel shown in FIG. 3.

Figure 5A:
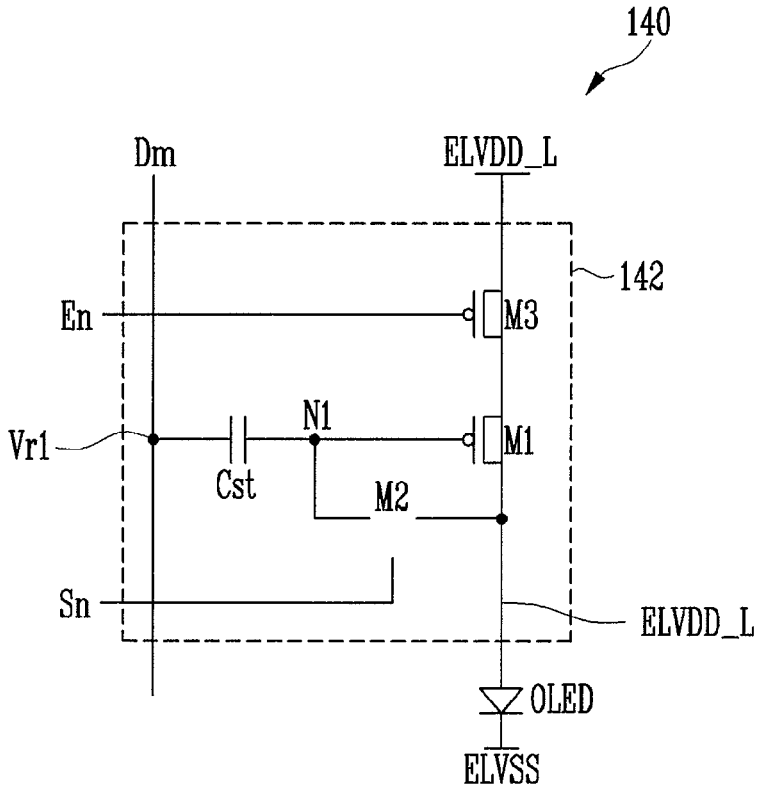
FIGS. 5A to 5E are waveform diagrams showing an embodiment of a second driving method of a pixel shown in FIG. 3.
Figure 5A:
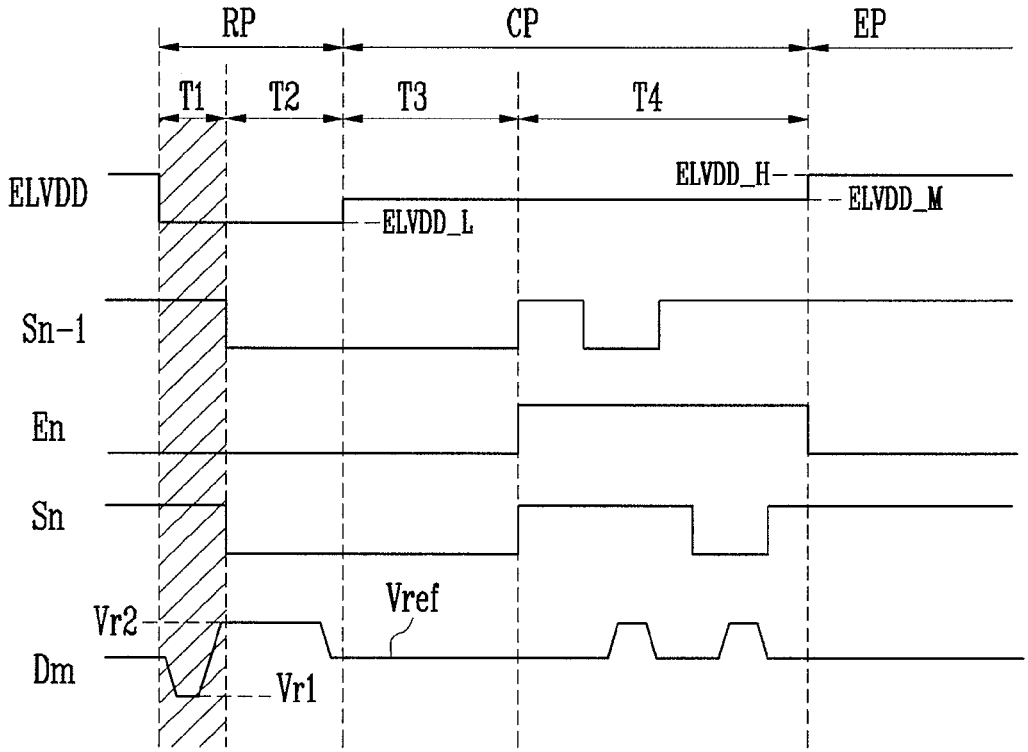

Herein, an operation process is described. First, a first low power ELVDD_L is supplied to a pixel circuit 142 and a first reset voltage Vr1 is supplied to a data line Dm during a first period T1 of a reset period RP as shown in FIG. 5A. When the first reset voltage Vr1 is supplied to the data line Dm, the voltage at a first node N1 drops because N1 is coupled to a storage capacitor Cst. The drop in voltage at a first node N1 causes the first transistor M1 to be switched on. When the first transistor M1 is switched on, the voltage of an anode electrode of an organic light emitting diode OLED drops to the voltage of a first low power ELVDD_L.

Figure 5B:
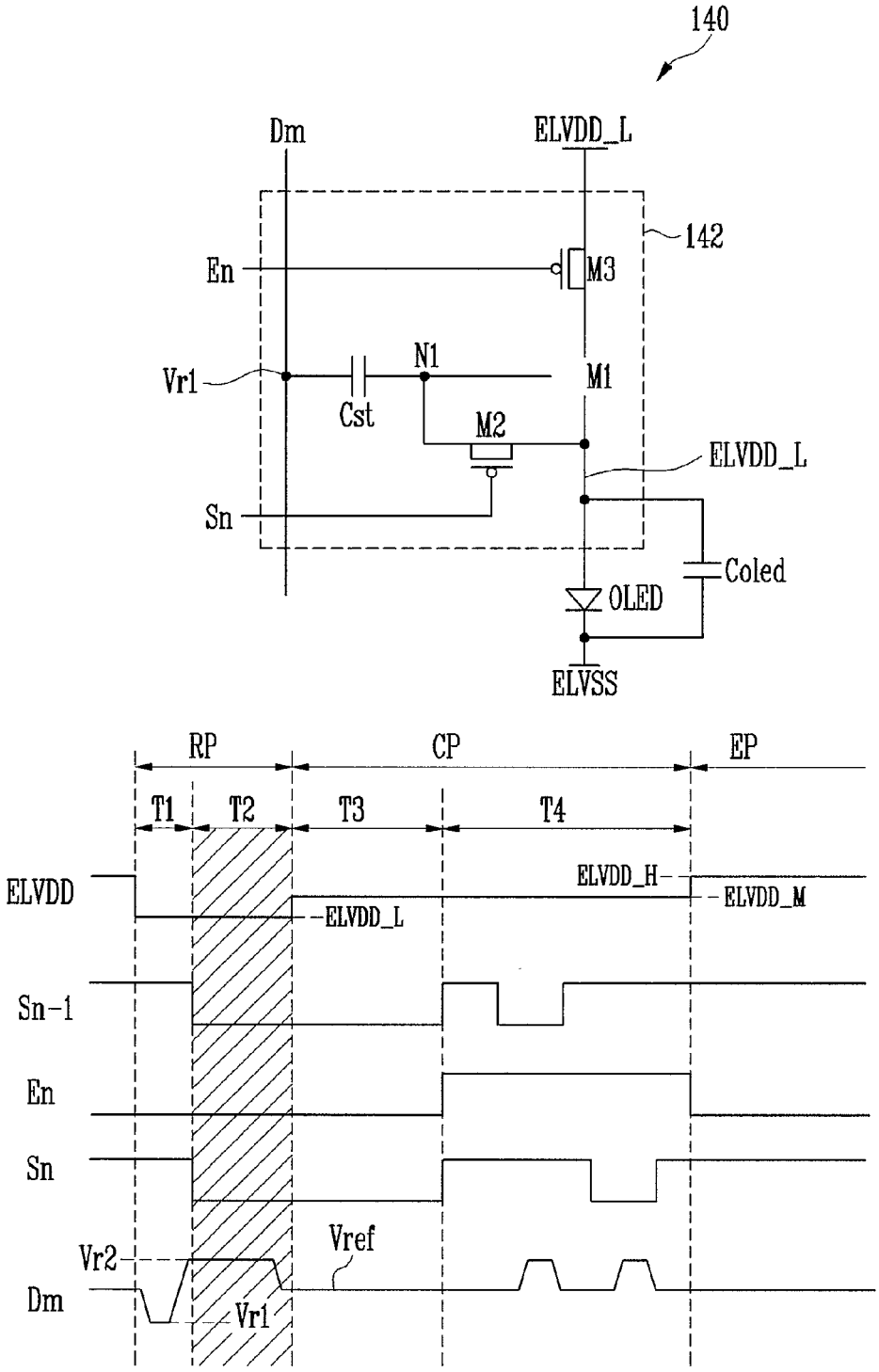

During a second period T2 of the reset period RP, as shown in FIG. 5B, a scan signal is supplied to each of scan lines S1 to Sn at the same time, and a second reset voltage Vr2 is supplied to a data line Dm. When the second reset voltage Vr2 is supplied to the data line Dm, the voltage at the first node N1 increases because N1 is coupled to the storage capacitor Cst. This increase in voltage at the first node N1 causes the first transistor M1 to be switched off.

When the scan signal is supplied to the scan line Sn, a second transistor M2 is switched on. When the second transistor M2 is switched on, the first node N1 and the anode electrode of the organic light emitting diode OLED are electrically connected to each other. In this case, the voltage at the first node N1 drops to the voltage of the first low power ELVDD_L by the charge sharing between a voltage charged in the storage capacitor Cst and a parasite capacitor formed by the organic light emitting diode OLED.

Figure 5C:
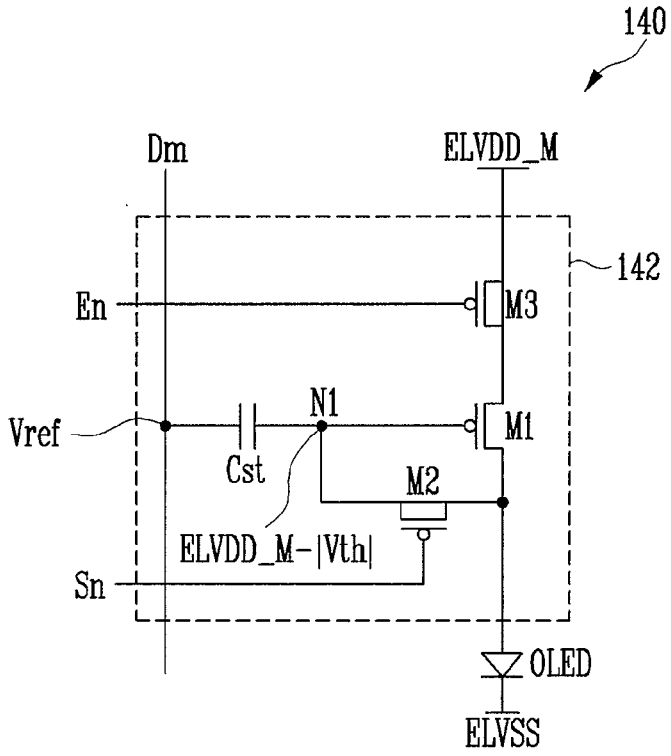
Figure 5C:
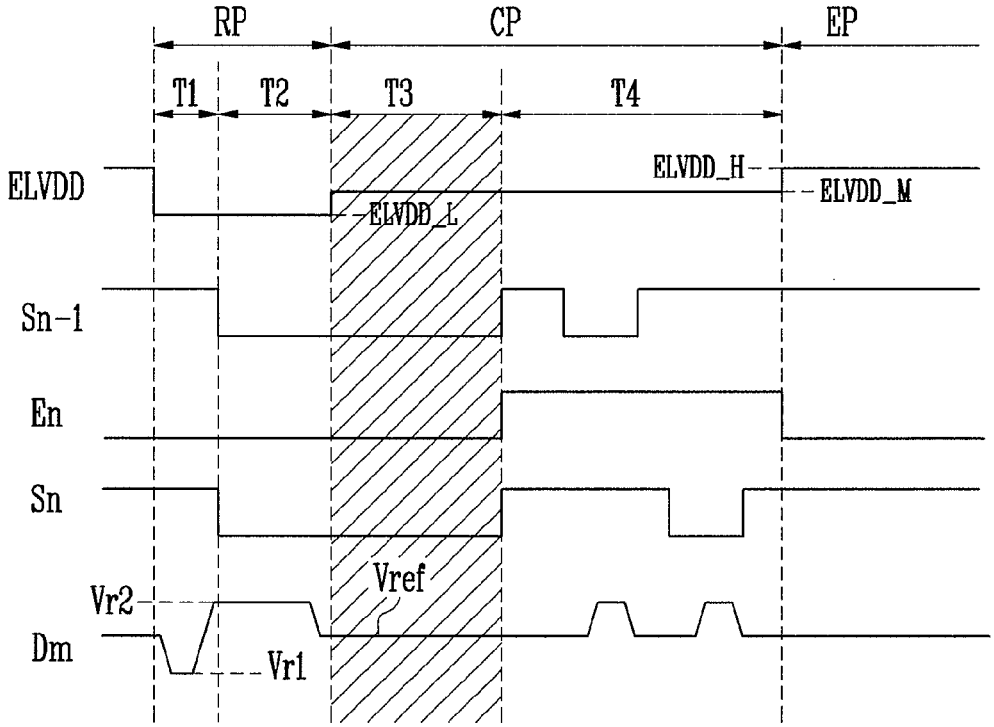

The driver for the compensation period CP is divided into a third period T3 and a fourth period T4. During the third period T3, as shown in FIG. 5C, the scan signal is supplied to the scan lines S1 to Sn and the emission control signal is not supplied to the emission control lines E1 to En. This means the third transistor M3 is switched on. In addition, during the third period T3, the first power ELVDD_M is supplied to the data line Dm while the reference voltage Vref is supplied to the data line Dm.

When the scan signal is supplied to the scan line Sn, the second transistor M2 is switched on. When the second transistor M2 is switched on, the first medium power ELVDD_M is supplied to the first node N1 through the third transistor M3, the first transistor M1, and the second transistor M2. When the second transistor M2 is switched on, the first transistor M1 acts as a diode, so the voltage at the first node N1 is set to a voltage resulting from subtracting the threshold voltage of the first transistor M1, Vth, from the voltage of the first medium power ELVDD_M. During the third period T3, the storage capacitor Cst is charged with a voltage corresponding to the difference in voltage between the reference voltage Vref supplied to the data line Dm and the voltage applied at the first node N1.

As described above, the third period T3 is used as a period to compensate for the threshold voltage of the first transistor M1. In this case, even in high-speed driving at 120 Hz or more, it is possible to compensate for the threshold voltage of the first transistor M1 for a sufficient time by controlling the width of the third period T3.

Figure 5D:
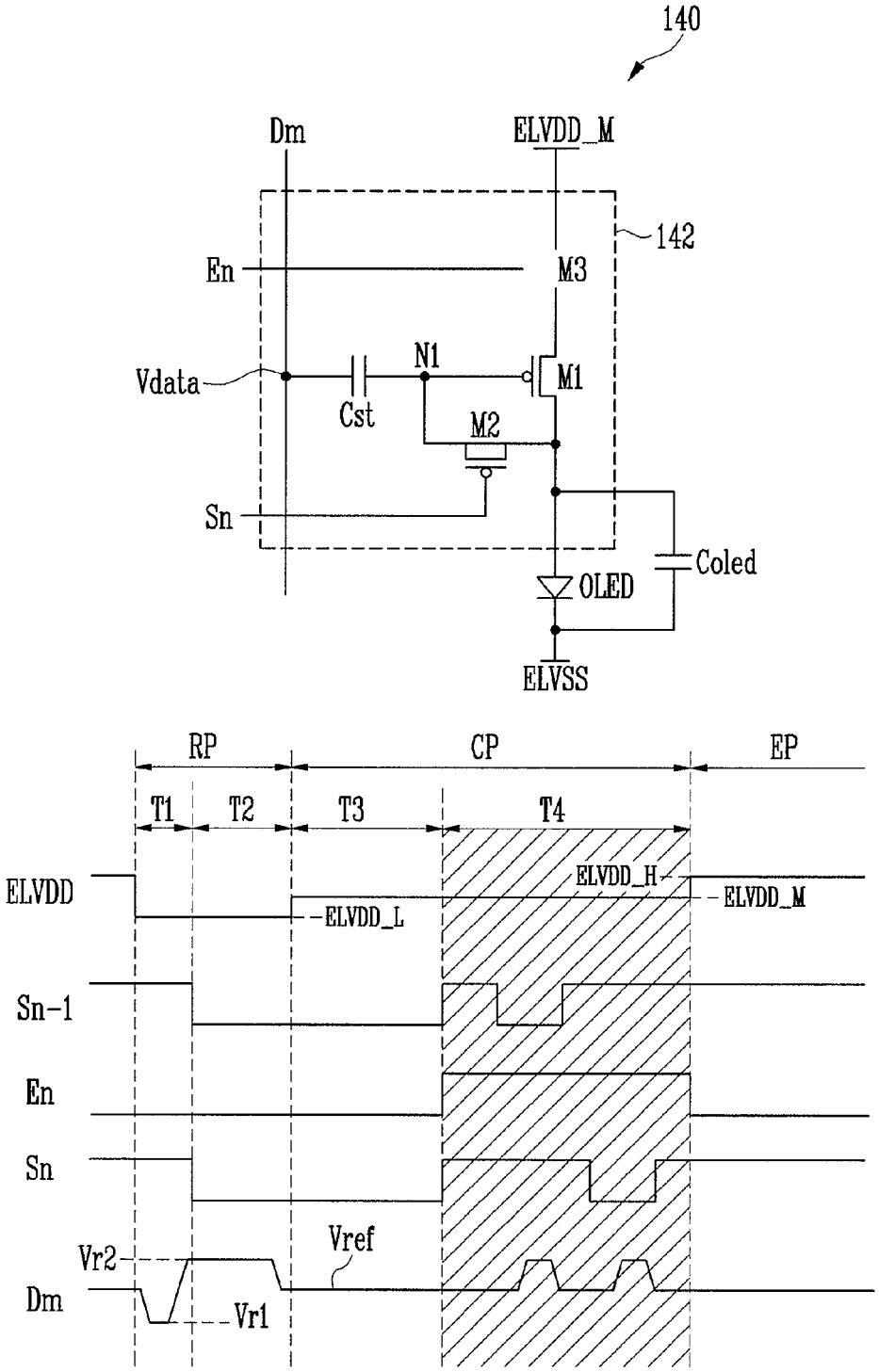

During the fourth period T4, as shown in FIG. 5D, the scan signal is sequentially supplied to the scan lines S1 to Sn. During T4, the data driver 120 supplies the reference power Vref and the data signal to the data lines D1 to Dm. The data signal is synchronized with the scan signal. In other words, the data driver 120 supplies the reference voltage Vref to the data lines D1 to Dm during a part of the fourth period T4, and supplies the data signal to the data lines D1 to Dm during the rest of the fourth period T4. In addition, the emission control signal is supplied to the emission control lines E1 to En during the fourth period T4. When the emission control signal is supplied to the emission control line En, the third transistor M3 is switched off.

Meanwhile, during a period when the scan signal is supplied to the first scan line S1 to the n−1-th scan line Sn−1 among the fourth period T4, the storage capacitor Cst included in the pixel 140 connected with the n-th scan line Sn maintains a voltage charged during the third period T3. This is because the second transistor M2 is switched off when no scan signal is supplied to the scan line Sn, thereby electrically isolating the storage capacity Cst and the first node N1. In other words, the first node N1 of the pixel 140 connected with the n-th scan line Sn is set to the floating state, such that the storage capacitor Cst maintains a voltage charged during the previous period regardless of a voltage change in the data line Dm.

Thereafter, a data signal is supplied to the data line Dm while the scan signal is supplied to the n-th scan line Sn. When the scan signal is supplied to the n-th scan line Sn, the second transistor M2 is switched on. During a period when the second transistor M2 is switched on, the voltage of the data line Dm is changed from the reference voltage Vref to the data signal voltage Vdata.

In this case, the change in voltage at the first node N1, $\Delta V_{N1}$, corresponds to the capacities of the storage capacitor Cst and the parasite capacitor (parasitic capacitance) $C_{OLED}$ and a voltage corresponding to the voltage change in the data line Dm, ΔV. The change in voltage at the first node N1 is shown in Equation 3.

$$\Delta V_{N1}=\{C\text{st}/(C\text{st}+C_{OLED})\}\times\Delta V \quad \text{Equation 3}$$

The voltage charged in the storage capacitor Cst is equal to a voltage difference between the two ends of the storage capacitor Cst. This voltage difference is the difference in voltage between the voltage of the data signal supplied to data line Dm and the voltage at the first node N1.

Figure 5E:
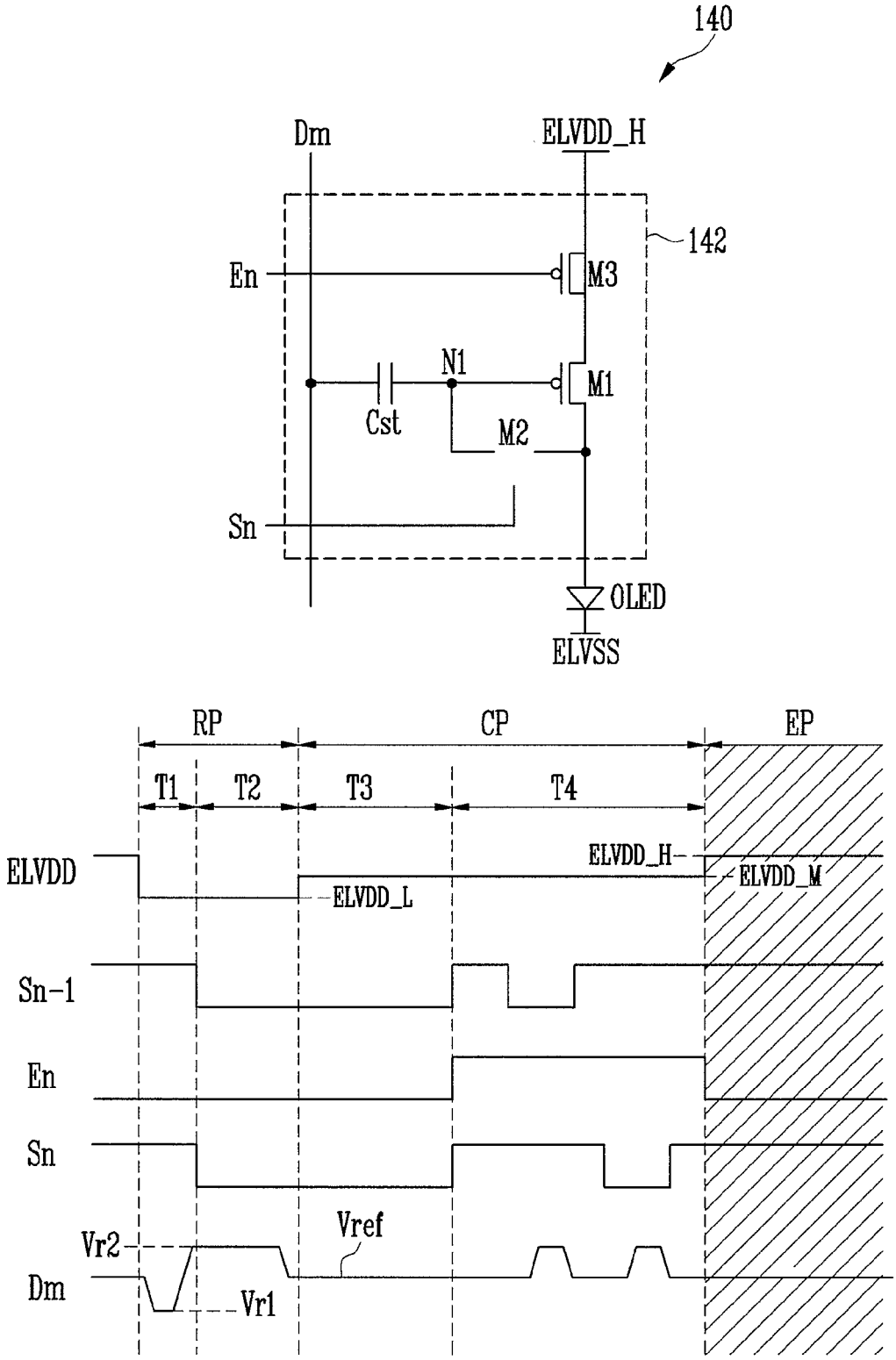

During the emission period EP, as shown in FIG. 5E, the first high power ELVDD_H is supplied. In addition, an emission control signal is not supplied to emission control lines E1 to En during the emission period EP. When the emission control signal is not supplied to the emission control lines E1 to En, the third transistor M3 is switched on. The first transistor M1 was previously switched on during T3 and remained switched on due to a voltage supplied by the storage capacitor Cst. When the third transistor M3 is switched on, the first transistor M1 supplies a current corresponding to the voltage applied to the first node N1 from the first power ELVDD to the second power ELVSS through the organic light emitting diode OLED.

Meanwhile, a voltage corresponding to the threshold voltage Vth of the first transistor M1 is applied to the first node N1 by the storage capacitor Cst, such that the current supplied from the first transistor M1 to the organic light emitting diode $I_{OLED}$ is set regardless of the threshold voltage Vth of the first transistor M1.

Figure 6:
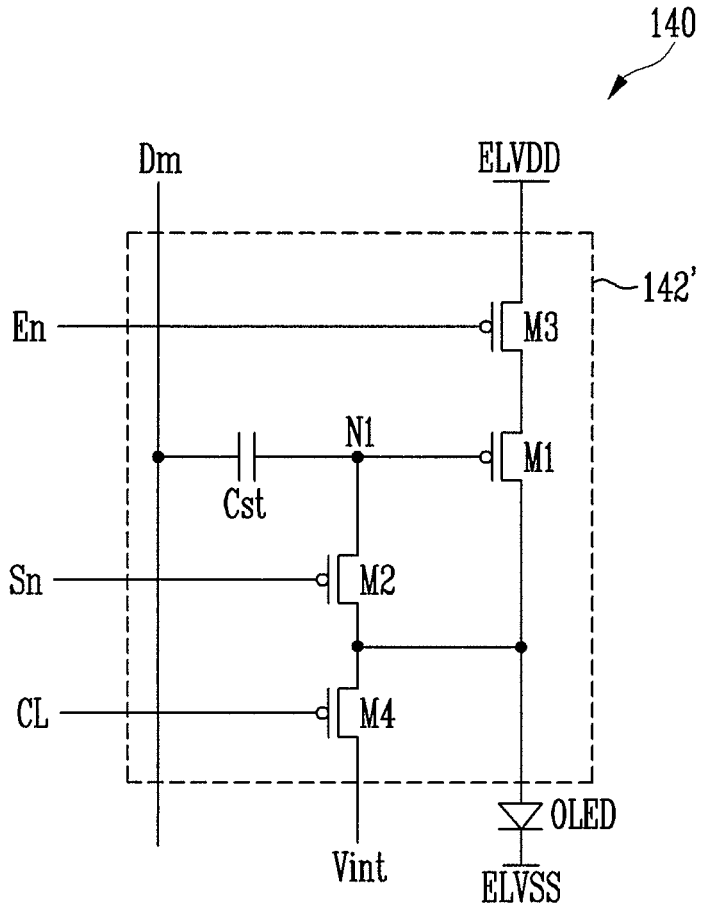
FIG. 6 is a circuit diagram showing a second embodiment of a pixel shown in FIG. 2.

FIG. 6 is a diagram showing a pixel 140 according to a second embodiment of the present invention. When FIG. 6 is described, the same reference numerals as those of FIG. 3 refer to the same components and a detailed description thereof will not be provided again. In addition, a pixel 140 connected to an n-th scan line Sn and an m-th data line Dm is shown for convenience of description.

Referring to FIG. 6, the pixel 140 according to the second embodiment of the present invention includes an organic light emitting diode OLED and a pixel circuit 142'.

The pixel circuit 142' is connected between an anode electrode of an organic light emitting diode OLED and an initial voltage Vint and includes a fourth transistor M4 that is switched on when a scan signal is supplied to a control line CL. Herein, the control line CL is commonly connected to each of the plurality of pixels 140 shown in FIG. 2. In addition, a control signal supplied to the control line CL is superimposed on the scan signal that is supplied to scan lines S1 to Sn during a reset period RP. Meanwhile, the control signal supplied to the control line CL may be supplied from a timing controller 150 shown in FIG. 2 or a different driver.

The fourth transistor M4 is switched on when the control signal is supplied to the control line CL. This supplies the initial voltage Vint to the anode electrode of the organic light emitting diode OLED. This also supplies the initial voltage Vint to the gate electrode of the first transistor M1 if the second transistor M2 is also switched on. Herein, the initial voltage Vint is set to a voltage equal to the first low power ELVDD_L.

Figure 7:
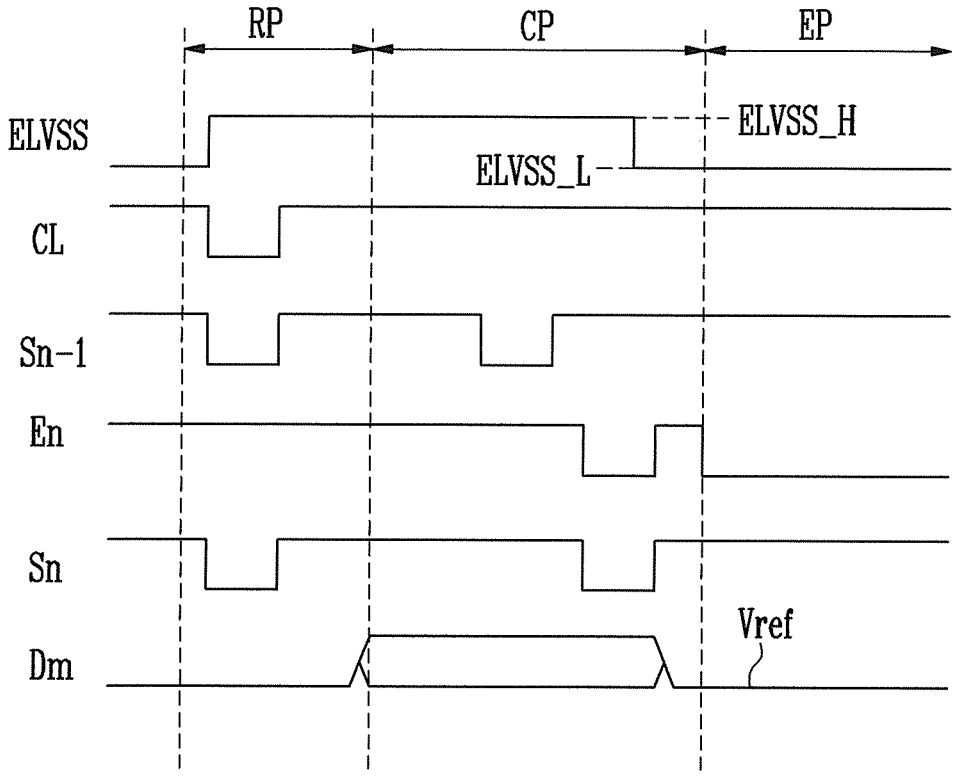
FIG. 7 is a waveform diagram showing an embodiment of a driving method of a pixel shown in FIG. 6.

FIG. 7 is a waveform diagram showing an embodiment of a driving method of a pixel shown in FIG. 6.

Referring to FIG. 7, during the reset period RP, a second high power (or a second power at a high level) ELVSS_H is supplied to the pixel circuit 142' by a second power supply not shown. The scan signal is supplied to the scan lines S1 to Sn at the same time the second high power ELVSS_H is supplied. Further, during the reset period RP, the control signal is supplied to the control line CL that is synchronized with the scan signal.

When the scan signal is supplied to the scan line Sn, the second transistor M2 is switched on. When the second transistor M2 is switched on, the anode electrode of the organic light emitting diode OLED and a first node N1 are electrically connected to each other.

When the control signal is supplied to the control line CL, the fourth transistor M4 is switched on. When the fourth transistor M4 is switched on, the initial voltage Vint is supplied to the anode electrode of the organic light emitting diode OLED and the first node N1.

During the compensation period CP, the scan signal is supplied to the scan lines S1 to Sn in sequence, and the emission control signal is supplied to emission control lines E1 to En. Herein, an emission control signal supplied to an i-th emission control line Ei is supplied during the rest of the compensation period CP except for a period when the scan signal is supplied to the i-th scan line Si.

When the scan signal is supplied to the scan line Sn, the second transistor M2 is switched on. In addition, during the period when the scan signal is supplied to the scan line Sn, the emission control signal is not supplied to the emission control line En. This means that the third transistor M3 is switched on. Therefore, during the compensation period CP, a voltage resulting from subtracting the threshold voltage of the first transistor M1, Vth, from a first power ELVDD is applied to the first node N1. Meanwhile, a storage capacitor Cst is charged with a voltage corresponding to the difference in voltage between the data signal voltage Vdata supplied to the data line Dm and the voltage applied to the first node N1.

During the compensation period CP, the second high power ELVSS_H is set to a voltage at which the organic light emitting diode OLED can be turned off. This is to prevent unnecessary light from being emitted from the organic light emitting diode OLED. For example, when the voltage of the second high power ELVSS_H is set to 2V and the threshold voltage of the organic light emitting diode is set to 3V, the voltage of the first power ELVDD is set to 5V or less. During the compensation period CP, a voltage resulting from subtracting the threshold voltage of the first transistor M1, Vth from the first power ELVDD is applied to the first node N1.

Thereafter, when the scan signal to the scan line Sn is no longer supplied, the first node N1 is set to a floating state. This is because the second transistor M2 is switched off, thereby electrically isolating a storage capacitor Cst and the first node N1. Therefore, even though the voltage supplied to the data line Dm is changed, the voltage charged in the storage capacitor Cst is stably maintained.

During the emission period EP, a second low power ELVSS_L (or a second power at a low level) is supplied and the reference voltage Vref is supplied to the data line Dm. Herein, the second low power ELVSS_L is set to a voltage at which a current can be supplied to the organic light emitting diode OLED and the reference power Vref is set to a voltage equal to or lower than a data signal voltage Vdata.

When the reference voltage Vref is supplied to the data line Dm, the voltage of the data line Dm decreases down to the reference voltage Vref from the data signal voltage Vdata. In this case, the voltage at the first node N1, $V_{N1}$, is set as shown in Equation 1, and the current flowing to the organic light emitting diode OLED, $I_{OLED}$, is set as shown in Equation 2.

As described above, the driving principle for a pixel 140 according to the second embodiment of the present invention is the same as that for the pixel 140 according to the first embodiment of the present invention except that the first node N1 and the anode electrode of the organic light emitting diode OLED are initialized by using the additional fourth transistor M4 in the second embodiment. That is, even in the pixel 140 according to the second embodiment of the present invention, it is possible to display an image having desired luminance regardless of the threshold voltage of the first transistor M1.

While the present invention has been described in connection with certain exemplary embodiments, it is to be understood that the invention is not limited to the disclosed embodiments, but, rather is intended to cover various modifications and equivalent arrangements included within the spirit and scope of the appended claims, and equivalents thereof.

What is claimed is:

1. A pixel, comprising:

an organic light emitting diode comprising an anode electrode and a cathode electrode, wherein the cathode electrode is connected with a second power supply;

a first transistor comprising a gate electrode, wherein the first transistor is connected between a first power supply and the organic light emitting diode, wherein the first transistor is configured to control an amount of current flowing from the first power supply through the organic light emitting diode to the second power supply;

a second transistor connected between the gate electrode of the first transistor and the anode electrode of the organic light emitting diode;

a third transistor connected between the first transistor and the first power supply; and a storage capacitor connected between the gate electrode of the first transistor and a data line.

2. The pixel of claim 1, further comprising:

a fourth transistor connected between the anode electrode of the organic light emitting diode and an initial power supply.

3. The pixel of claim 2, wherein the second transistor and the fourth transistor are configured to turn on concurrently with each other when a data signal is not supplied to the data line during a part of a frame period.

4. The pixel of claim 3, wherein the data line is configured to supply the data signal, wherein the second transistor is configured to switched on when the data signal is supplied, and wherein the fourth transistor is configured to switched off when the data signal is supplied.

5. The pixel of claim 4, wherein the third transistor is configured to switched on simultaneously with the second transistor when the data signal is supplied to the data line.

6. The pixel of claim 1, wherein the third transistor is configured to switched on during a period when current flows from the first transistor to the organic light emitting diode.

7. The pixel of claim 1, wherein the second transistor and the third transistor are configured to switch concurrently with on each other during a part of a period of a frame when a data signal is not supplied to the data line.

8. The pixel of claim 1, wherein the second transistor is configured to be set to a switched-on state during a period when a data signal is supplied to the data line.

9. An organic light emitting display device in which a frame is driven by being divided into a reset period, a compensation period, and an emission period, the organic light emitting display device comprising:

a plurality of pixels at a plurality of crossing regions of a plurality of scan lines, a plurality of emission control lines, and a plurality of data lines, the plurality of pixels being configured to be in a non-emission state during the reset period and the compensation period, and in an emission state during the emission period;

a data driver configured to sequentially supply a first reset voltage and a second reset voltage to each of the plurality of data lines during the reset period;

a scan driver configured to simultaneously supply a scan signal to each of the plurality of scan lines during the reset period, wherein the scan driver is also configured to supply an emission control signal to each of the plurality of emission control lines; and a first power supply configured to supply a first power to each of the plurality of pixels, wherein the first power has different voltage levels during the reset period, the compensation period, and the emission period.

10. The organic light emitting display device of claim 9, wherein each of the plurality of pixels comprises:

an organic light emitting diode comprising an anode electrode and a cathode electrode, wherein the cathode electrode is connected with a second power supply;

a first transistor comprising a gate electrode, wherein the first transistor is connected between the first power supply and the organic light emitting diode, wherein the first transistor is configured to control an amount of current flowing from the first power supply through the organic light emitting diode to the second power supply;

a second transistor connected between the gate electrode of the first transistor and the anode electrode of the organic light emitting diode, wherein the second transistor is configured to be switched on when the scan signal is supplied to a scan line of the plurality of scan lines;

a third transistor connected between the first transistor and the first power, wherein the third transistor is configured to be switched off when the emission control signal is supplied to an emission control line of the plurality of emission control lines; and a storage capacitor connected between the gate electrode of the first transistor and a data line of the plurality of data lines.

11. The organic light emitting display device of claim 10, wherein the first power supply is configured to supply the first power at a low level during the reset period; is configured to supply the first power at a medium level during the compensation period, wherein the first power at the medium level is a voltage higher than the first power at the low level; and is configured to supply the first power at a high level during the emission period, wherein the first power at the high level is a voltage higher than the first power at the medium level.

12. The organic light emitting display device of claim 11, wherein the first power at the low level is configured to be set to a voltage equal to or lower than the second power.

13. The organic light emitting display device of claim 11, wherein the first power at the medium level is configured to be set to a voltage at which the organic light emitting diode is turned off.

14. The organic light emitting display device of claim 11, wherein the first power at the high level is configured to be set to a voltage at which a current is supplied to the organic light emitting diode.

15. The organic light emitting display device of claim 10, wherein the first reset voltage is configured to be set to a voltage at which the first transistor is switched on.

16. The organic light emitting display device of claim 10, wherein the second reset voltage is configured to be set to a voltage at which the first transistor is switched off.

17. The organic light emitting display device of claim 10, wherein the scan driver is configured to supply the scan signal to the plurality of scan lines, wherein the scan signal is configured to be synchronized with the second reset voltage.

18. The organic light emitting display device of claim 10, wherein the scan driver is configured to sequentially supply the scan signal to the plurality of scan lines during the compensation period and is configured to supply the emission control signal to the plurality of emission control lines during a fourth period, wherein the fourth period is a part of the compensation period.

19. The organic light emitting display device of claim 18, wherein i is a natural number, wherein the scan driver is configured to supply the emission control signal to an i-th emission control line of the plurality of emission control lines during the fourth period; and the scan driver is configured to supply a scan signal to an i-th scan line of the plurality of scan lines during the fourth period.

20. The organic light emitting display device of claim 18, wherein the data driver is configured to supply a data signal to the plurality of data lines and the data signal is configured to be synchronized with the scan signal supplied during the compensation period.

21. The organic light emitting display device of claim 20, wherein the data driver is configured to supply a reference power having a voltage equal to or lower than the data signal during the emission period.

22. The organic light emitting display device of claim 10, wherein the scan driver is configured to simultaneously supply the scan signal to the plurality of scan lines during a third period, wherein the third period and a fourth period are a part of the compensation period, and the third period does not overlap with the fourth period; is configured to sequentially supply the scan signal to the plurality of scan lines during the fourth period; and is configured to supply the emission control signal to each of the plurality of emission control lines during the fourth period.

23. The organic light emitting display device of claim 22, wherein the data driver is configured to supply a reference power to the plurality of data lines during the third period.

24. The organic light emitting display device of claim 23, wherein the data driver is configured to consecutively supply the reference power and a data signal to the data lines whenever the scan signal is supplied during the fourth period.

25. An organic light emitting display device in which a frame is driven by being divided into a reset period, a compensation period, and an emission period, the organic light emitting display device comprising:

a plurality of pixels at a plurality of crossing regions of a plurality of scan lines, a plurality of emission control lines, and a plurality of data lines, the plurality of pixels configured to be in a non-emission state during the reset period and the compensation period, and in an emission state during the emission period;

a scan driver configured to supply a scan signal to each of the plurality of scan lines during the reset period and configured to sequentially supply the scan signal to each of the plurality of scan lines during the compensation period, wherein the scan driver is also configured to supply an emission control signal to each of the plurality of emission control lines; and a data driver configured to supply a data signal to each of the plurality of data lines, wherein the data signal is synchronized with the scan signal during the compensation period.

26. The organic light emitting display device of claim 25, wherein each of the plurality of pixels comprises:

an organic light emitting diode comprising an anode electrode and a cathode electrode, wherein the cathode electrode is connected with a second power supply for supplying a second power;

a first transistor comprising a gate electrode, wherein the first transistor is connected between a first power supply for supplying a first power and an organic light emitting diode, wherein the first transistor is configured to control an amount of current flowing from the first power supply through the organic light emitting diode to the second power supply;

a second transistor connected between the gate electrode of the first transistor and the anode electrode of the organic light emitting diode, wherein the second transistor is configured to be switched on when the scan signal is supplied to a scan line of the plurality of scan lines;

a third transistor that is connected between the first transistor and the first power, wherein the third transistor is configured to be switched off when the emission control signal is supplied to an emission control line of the plurality of emission control lines;

a fourth transistor connected between the anode electrode of the organic light emitting diode and an initial power supply, wherein the fourth transistor is configured to be switched on when a control signal is supplied to a control line; and a storage capacitor connected between the gate electrode of the first transistor and a data line of the plurality of data lines.

27. The organic light emitting display device of claim 26, wherein the second power is configured to be set to a high-level voltage during the reset period and the compensation period and the second power is configured to be set to a low-level voltage during the emission period.

28. The organic light emitting display device of claim 27, wherein the high-level voltage is configured to prevent a current to flow to the organic light emitting diode and the low-level voltage is configured to enable the current to flow to the organic light emitting diode.

29. The organic light emitting display device of claim 26, wherein the control signal is configured to be supplied simultaneously with the scan signal during the reset period.

30. The organic light emitting display device of claim 26, wherein i is a natural number and the scan driver is configured to supply the emission control signal to an i-th emission control line of the plurality of emission control lines during a fourth period, wherein the fourth period is a part of the compensation period.

* * * * *